US005131876A

United States Patent [19]

Vieux et al.

[11] Patent Number: 5,131,876

[45] Date of Patent: Jul. 21, 1992

[54] IMAGE PICK-UP ELECTRON TUBE WITH MOLDED SIGNAL INPUT PLATE AND FABRICATION METHOD THEREOF

[75] Inventors: Gérard Vieux, Grenoble; Didier Monin, La Tour du Pin; Jean-Luc Ricaud, Voreppe, all of France

[73] Assignee: Thomson Tubes Electroniques, Boulogne Billancourt, France

[21] Appl. No.: 510,857

[22] Filed: Apr. 18, 1990

[30] Foreign Application Priority Data

Apr. 25, 1989 [FR] France ..... 89 05454

[51] Int. Cl.[5] ..... H01J 9/00

[52] U.S. Cl. ..... 445/22; 445/52

[58] Field of Search ..... 445/22, 52, 58; 65/48, 65/49, 61; 313/371, 384, 542, 544

[56] References Cited

U.S. PATENT DOCUMENTS

| | | | |
|---|---|---|---|
| 3,190,738 | 6/1965 | Upton | 65/61 X |
| 3,417,448 | 12/1968 | Kelley | 65/49 X |
| 4,661,079 | 4/1987 | Harris et al. | 445/22 |

FOREIGN PATENT DOCUMENTS

| | | | |
|---|---|---|---|
| 0232774 | 8/1987 | European Pat. Off. . | |
| 9953 | 1/1981 | Japan | 313/371 |
| 9954 | 1/1981 | Japan | 313/371 |

OTHER PUBLICATIONS

Patent Abstracts of Japan, vol. 2, No. 154, (E-78) (9949), Dec. 25, 1978, & JP-A-52 37 611, Oct. 27, 1978, K. Watanabe, "Manufacture of Pickup-Tube Target".

*Primary Examiner*—Kenneth J. Ramsey

*Attorney, Agent, or Firm*—Oblon, Spivak, McClelland, Maier & Neustadt

[57] ABSTRACT

The disclosure concerns television cameras having an image pick-up electron tube. The signal input plate of the tube according to the invention is made by molding and a connection pin is embedded in the glass during the molding operation itself. When the internal and external faces of the input plate are then polished, the end of the pin on the internal side of the pin is levelled down at the same time. All that remains to be done then is to deposit a transparent conductive layer and a photoconductive target on this perfectly plane face. Furthermore, the unpolished edges of the input plate and, more particularly, its lateral edges are covered with a light-absorbing black layer which is produced not by the deposition of a black paint but by chemical reduction of the metal oxides contained in the glass. This blackening is preferably obtained during the molding operation itself, by placing the mold in a hydrogen-reducing atmosphere.

12 Claims, 2 Drawing Sheets

IMAGE PICK-UP ELECTRON TUBE WITH MOLDED SIGNAL INPUT PLATE AND FABRICATION METHOD THEREOF

BACKGROUND OF THE INVENTION

1. Field of the Invention

The invention concerns television cameras having image pick-up electron tubes.

An image pick-up tube is a vacuum tube with a frontal surface constituted by a plane photosensitive target on which, by means of lenses or other optical means, there is focused an image that is to be converted into an electrical signal called a video signal.

The tube includes an electron gun placed in the rear of the photosensitive target to produce a narrow electron beam directed towards this target, focusing means to focus this beam on the target, and deflection means to subject the beam (and consequently its point of impact on the target) to a scanning of the surface of the target or of a part of this surface.

To give a video signal representing the illumination of each point of the target, the front face of the target is coated with a transparent electrode that is connected to an output connection terminal at which will be extracted the signal current which, after processing, becomes the video signal. This electrode is called a signal electrode.

This transparent electrode is a thin conductive layer deposited on the signal input plate (hereinafter called an input plate) of the tube, the input plate being made of transparent glass (optical glass). The invention can be applied to the case where the photosensitive target proper is a layer of photosensitive material deposited on the input plate on top of the transparent electrode. It can be applied notably to the case of a target made of photoconductive material.

In the case of a target made of photoconductive material, the signal electrode is biased at a positive voltage with respect to the cathode of the electron gun. Positive charges are created by photoconductive effect when a light image is focused on the target. The quantity of charges at a given point of the target is proportional to the integral of the illumination received at this point. These localized charges migrate towards the surface of the target on the electron gun side under the effect of the internal electrical field in the photoconductive material. The charges localized at a point of the target are compensated for by the arrival of electrons when the beam from the electron gun touches this point. This then prompts the flow, through the signal electrode, of a corresponding quantity of negative charges, by capacitive discharge, through the material of the target. The time-related variation of flow of charges forms a signal current which, as and when the target is scanned by the beam, represents the luminous information received at each point of the target.

2. Description of the Prior Art

One of the technical problems that has to be resolved for making the image input plate of the image pick-up tube is that of the output of the video signal through the signal electrode and then through the external connection terminal to which this signal electrode is connected. For, the transparent signal electrode is deposited on the plate on the side internal to the tube (which is a vacuum tube) while the signal has to be transmitted outwards.

FIG. 1 shows a known structure of a prior art input plate. In this structure, the plate is formed by two transparent glass sheets bonded to each other, the larger one (10) of these two sheets being, for example, circular and having the diameter of the image pick-up tube for which it is the input element, the smaller one (12) of these two sheets having, for example, a rectangular format corresponding to the format of the image which actually has to be observed. This second sheet has, for example, the function of improving the image contrast by anti-halo effect, of adjusting the optical path by the thickness of the sheet or any other function. The input plate is formed in two steps: the first sheet (10), which is the larger one, is first of all polished on both its faces so as to be quite plane. Then it is pierced with a hole for the passage of a connection terminal 14 going through it. The hole is formed outside the useful image field, namely outside the zone which will be covered by the second sheet.

The transparent signal electrode 16, made of indium-tin oxide (ITO) for example, is deposited by sputtering on the internal face of the input plate (the side internal to the tube). Then, the connection pin 14 is introduced into the hole. A solder (18) is then made between the pin and the deposited electrode. This is a vacuum-sealed solder with an alloy that has a low melting point and is preferably indium-based. As shown in the figure, the solder covers the pin and a part of the transparent electrode that surrounds it.

The photoconductive layer 20 is then deposited. There is perfect electrical contact between the photoconductive layer 20 and the transparent electrode 16 and, hence, also with the connection pin 14.

In the case of FIG. 1 (but this is not obligatory) a second sheet 12 of polished glass is bonded with a transparent bonder to the external face of the first sheet. The bonding may take place, for example, only when the first sheet is definitively mounted and fixed to the tube for which it forms the input element.

After the bonding operation, those parts that do not need to let through light are painted black (with a non-reflecting dull black paint). These parts are the lateral edges 24 and 26 of the first and second sheet respectively (the edges perpendicular to the face bearing the photoconductive target and the transparent electrode) and the edges 28 of the first sheet, around the second one, on the external face of the first sheet. On the one hand, this black paint absorbs the light received from the exterior, except on the useful surface defined by the second sheet. Secondly, it absorbs the light reflections inside the sheets. It thus serves to reduce what is called stray light.

SUMMARY OF THE INVENTION

An aim of the present invention is to improve the construction of the input plates of image pick-up tubes when there is only one plane glass plate as well as when there is also a second glass plate.

In particular, it is an aim of the invention to simplify the construction by reducing the number of fabrication steps.

Finally, another aim is to improve the working of the tube.

To this end, the invention proposes a new structure of an image pick-up tube input plate and a corresponding new fabrication method.

According to the invention, there is proposed a method wherein a connection pin is included directly in the molding operation and then the internal face and the external face of the input plate are polished. If the input plate is not a plate with a simple parallelepiped section, then it is molded in a mold having the corresponding shape. This is the case, for example, of an input plate having the stepped shape of FIG. 1, with a first level and a second level.

After the molding operation, the pin portions that go beyond the surface of the internal side of the input plate are levelled down. The glass is polished on its internal face and on the external face. The pin can be levelled down simultaneously with the glass polishing operation.

Preferably, an operation is done for blackening the glass by chemical reduction, under hydrogen, of the metallic impurities in the glass. This operation may take place during the molding (preferably), or after it but before the polishing operation. After the polishing operation, a transparent conductive layer is deposited on the internal side of the glass to form the signal electrode. For a photoconductive target, a layer of photoconductive material is then deposited on the transparent electrode.

The connection pin is preferably made of a conductive material having a heat expansion coefficient very close to that of the glass in which it is molded, for example an iron/nickel alloy with an appropriate composition.

The image pick-up tube according to the invention consequently has an input plate molded in one piece, with a connection pin embedded during the molding, the pin having one end that is flush with the surface of the glass on the internal side, this end of the pin being covered with a transparent electrode with which it is in electrical contact.

The input plate has a shape that may have two levels (or more), and the level on the external side may serve to demarcate a useful image field that is smaller than the surface of the input plate.

The lateral edges, and more generally the unpolished edges, of the input plate are covered with a light-absorbing layer produced by the chemical reduction of the glass when it undergoes heat processing in a reducing atmosphere such as a hydrogen atmosphere.

BRIEF DESCRIPTION OF THE DRAWINGS

Other features and advantages of the invention will appear from the following detailed description which is made with reference to the appended drawings, wherein.

DESCRIPTION OF PREFERRED EMBODIMENTS

Figure 1:
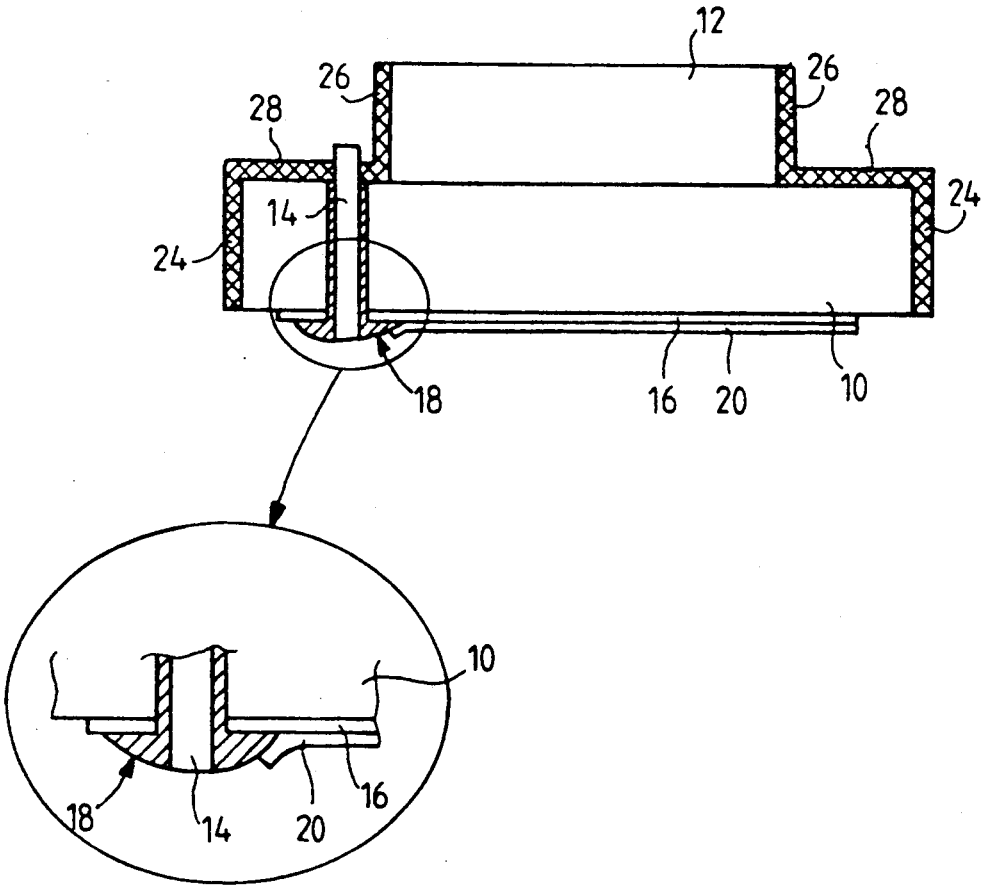
FIG. 1, already described, shows a prior art input plate.

We shall not return to FIG. 1 which shows a prior art input plate. The following figures show the steps in the fabrication of an input plate having, in common with the input plate of FIG. 1, the fact that it has a stepped shape with two levels. However, the method according to the invention can also be applied, with very few modifications, to an input plate with only one level (a single glass plate).

A transparent input plate 30, having the desired shape, is molded in the presence of a reducing atmosphere, preferably under hydrogen. The shape of the mold is the final shape desired, with or without levels, and a connection pin 32 is placed in the mold so that it is embedded in the glass.

The pin goes through the thickness of the glass at a place where it will not generate the transmission of the light image through the input plate. The pin goes beyond, firstly, the internal face side (at the bottom of the figures) and, secondly, the external face side (at the top in the figures) of the input plate.

Figure 2:
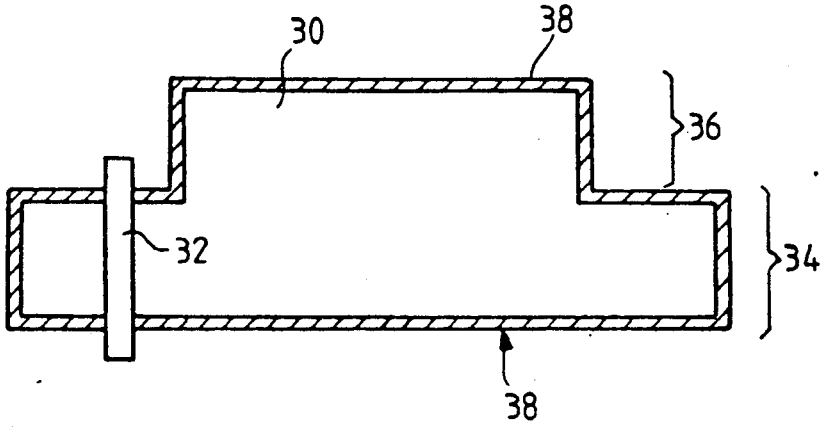
FIG. 2 shows a first step for the fabrication of the input plate according to a mode of implementation of the method of the invention.

In the example of FIG. 2 where the input plate has a base 34 (lower level) and a protuberance 36 (upper level) with a more restricted area, the pin 32 goes through the base outside the position of the protuberance.

The presence of a reducing atmosphere during the molding gives rise to a light-absorbing black layer 38 throughout the external surface of the glass. This layer comes from the reduction of the metal oxides in the glass. It is very superficial because hydrogen does not penetrate glass.

The pin 32 should be conductive and it is desirable for its expansion coefficient to be close to that of glass so that there are no great strains when the glass is being cooled upon leaving the mold. The pin is preferably made of an iron/cobalt/nickel alloy and the precise composition of the alloy is chosen as a function of the composition of the glass, the criterion being the matching of the expansion coefficients.

Figure 3:
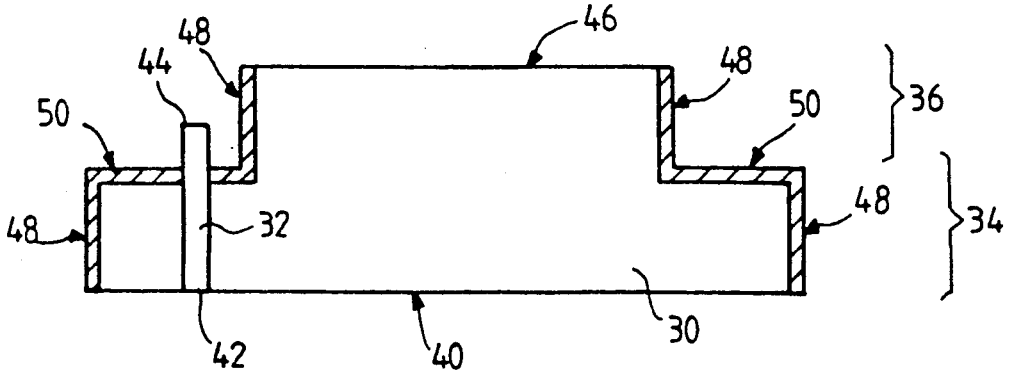
FIG. 3 shows a second step of fabrication of the input plate.

The next fabrication step, shown in FIG. 3, consists in polishing the internal face of the input plate (namely, the one that is inside the image pick-up tube and will be pointed towards the electron gun of the tube) and the external face (the one which will be outside and through which the light image to be converted into a video signal will arrive). The order in which the faces are polished is unimportant.

In polishing, it is precisely the end of the connection pin 32 going beyond the internal face side 40 that is levelled down until this end 42 is exactly or almost exactly flush with the plane of the polished face. However, it is preferably seen to it that the other end 44 of the connection pin is not levelled down so that it remains available for a connecting wire (not shown) to be soldered to it. For the making of an input plate with several levels, this is easy since the external face to be polished is in a plane before the plane from which the end 44 of the connection pin 32 emerges.

The operation for polishing the internal and external faces rids these faces of the black layer that covered them in the preceding step. The polished face 40 of the internal side and the polished face 46 of the external side are therefore perfectly transparent.

By contrast, the lateral edges 48 of the input plate on the base 34 and on the protuberance 36, and the portions 50 of the input plate on the base 34 around the protuberance 36 remain covered with the black layer because they are protected during the polishing operation.

Figure 4:
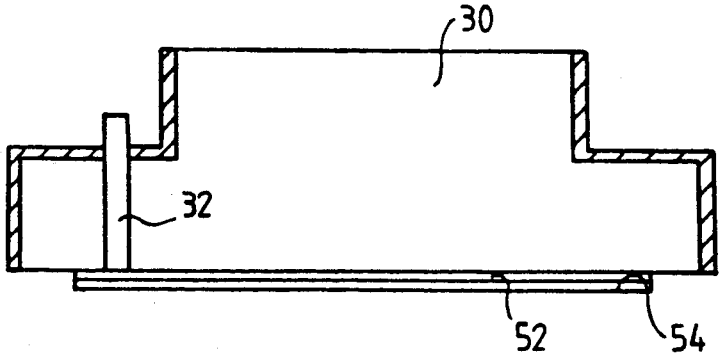
FIG. 4 shows a third and final step of fabrication of the input plate according to the invention.

The next operation, shown in FIG. 4, consists in finishing the input plate by depositing the signal electrode and the photosensitive target. First of all, a thin, transparent conductive layer 52 is deposited on the internal face 40 of the input plate. This layer is deposited by sputtering. The material used for the layer is preferably a conductive oxide such as indium-tin oxide. Then the photosensitive layer, herein the photoconductive layer 54, is deposited, also by sputtering, on top of the transparent electrode.

The electrical contact between the transparent electrode 52 and the connection pin 32 is perfect (with the sputtering of a conductor on the bare end of the pin).

The surface of the input plate on the internal side is perfectly plane, including at the place where the pin 32 is flush with this surface. The signal electrode and the photoconductive layer are therefore also perfectly plane throughout the surface, unlike what happened in the prior art where the solder between the pin and the electrode created a protuberance. Perfect planeity has the advantage notably of not deforming the equipotential surfaces in the region surrounding the end of the pin and, hence, of not introducing a disturbance in the trajectory of the electron beam scanning the target in this region. The harmful consequence of such a disturbance would be that, if this region were to overflow on to a part of the image format, then there would be a geometrical distortion in this part.

The input plate, thus finished, now only has to be mounted in the image pick-up tube. The periphery of the input plate, on the internal side of the tube, is joined to the rest of the tube in a vacuum-tight fashion, for example by means of a glass/indium sealing or a glass/-metal solder. It will be noted that there is no risk of leakage at the position of the connection pin as it is embedded in the glass. In the prior art technique, it was the solder 18 (FIG. 1) that provided imperviousness at the position of the pin, whence the need for a non-negligible solder thickness and the protuberance resulting therefrom.

The image pick-up tube according to the invention thus includes, in brief, an input plate such as the one seen in FIG. 4 (for example) with a connection pin molded in the glass, the end of this pin being exactly flush with the polished plane surface of the glass and being coated first of all with a thin, transparent conductive layer and then with a photosensitive layer. The lateral edges are blackened by heat treatment in a reducing atmosphere, and this is done preferably during the molding of the input plate.

Finally, it will be noted that the blackening by heat treatment in a reducing atmosphere could also be done after the molding (vacuum molding or molding in the presence of a neutral atmosphere), by means of high-temperature annealing in the presence of a reducing gas (hydrogen).

A structure may be envisaged where there is not just one but several connection pins such as 32, preferably distributed so as to reduce the strains in the input plate to the minimum. These pins are embedded during the operation for molding the glass.

What is claimed is:

1. A method for the fabrication of an input plate for an image pick-up tube, comprising the steps of:

molding a glass input plate, which includes a connection pin formed in the glass input plate during the molding;

subjecting said glass input plate to a chemical reduction to blacken the glass input plate; and polishing an internal face and external face of the glass input plate.

2. The method according to claim 1, wherein said polishing step further comprises polishing a portion of the connection pin which extends beyond the surface of the internal face of the glass input plate so that the connection pin is level with the polished surface of the internal face of the glass input plate.

3. The method according to claim 2, wherein the step of subjecting the glass input plate to a chemical reduction is performed during the molding operation by performing the molding in a presence of a reducing hydrogen atmosphere.

4. The method according to either of claims 1 or 2, further comprising the step:

depositing a transparent conductive layer on the polished internal face of the glass input plate to form a signal electrode, the transparent conductive layer being in electrical contact with the connection pin.

5. The method according to claim 4, further comprising the step of:

depositing a photosensitive material on the transparent conductive layer.

6. The method according to either of claims 1 or 2, wherein a stepped shape is given to the glass input plate during the molding step.

7. A method for the fabrication of an input plate for an image pick-up tube, comprising the steps of:

molding a glass input plate, which includes a connection pin formed in the glass input plate during the molding operation;

polishing an internal face and an external face of the glass input plate, including polishing a portion of the connection pin which extends beyond the surface of the internal face of the glass input plate so that the connection pin is level with the polished surface of the internal face of the glass input plate.

8. The method according to claim 7, further comprising the step of:

subjecting said glass input plate to a chemical reduction to blacken the glass input plate.

9. The method according to claim 8, wherein the step of subjecting the glass input plate to a chemical reduction is performed during the molding operation by performing the molding in a presence of a reducing hydrogen atmosphere.

10. The method according to either of claims 7 or 8, further comprising the step:

depositing a transparent conductive layer on the polished internal face of the glass input plate to form a signal electrode, the transparent conductive layer being in electrical contact with the connection pin.

11. The method according to claim 10, further comprising the step of:

depositing a photosensitive material on the transparent conductive layer.

12. The method according to either of claims 7 or 8, wherein a stepped shape is given to the glass input plate during the molding step.

* * * * *